US006712491B1

(12) United States Patent
Wu

(10) Patent No.: US 6,712,491 B1
(45) Date of Patent: Mar. 30, 2004

(54) LAMP ASSEMBLING DEVICE WITH ORIENTATION ADJUSTABLE LAMP POST

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/414,548

(22) Filed: Apr. 17, 2003

(51) Int. Cl.[7] ..... F21V 19/00

(52) U.S. Cl. ..... 362/427; 362/393; 362/405; 362/428

(58) Field of Search ..... 362/405, 427, 362/428, 429, 431, 147, 371, 413, 393

(56) References Cited

U.S. PATENT DOCUMENTS 759,924 A * 5/1904 Smith ..... 148/248
1,114,299 A * 10/1914 Severus ..... 362/393
6,276,819 B1 * 8/2001 Gordner ..... 362/398

* cited by examiner

*Primary Examiner*—Laura K. Tso

(57) ABSTRACT

A lamp assembling device with an orientation adjustable lamp post is disclosed. In a retaining seat, a positioning sheet is locked to the distal end of the lamp rod. An upper section of a vertical surface of the positioning sheet has a locking hole. A lower end of the adjusting rod has a through hole. An embedding hole is formed on the adjusting rod at an upper side of the through hole. Thereby, a stud passes through the limiting reed and the locking hole of the positioning sheet to be locked into the through hole of the adjusting rod. Thus, the adjusting rod, positioning sheet and limiting reed are locked as an integral body. After locking, one free end of the limiting reed exactly extends into an embedding hole of the adjusting rod. As a result, the lamp post is adjustable.

2 Claims, 6 Drawing Sheets

Fig. 2-A

LAMP ASSEMBLING DEVICE WITH ORIENTATION ADJUSTABLE LAMP POST

BACKGROUND OF THE INVENTION

The present invention relates to lamp assembling device, and particularly to a lamp assembling device with an orientation adjustable lamp post, wherein a stud passes through a limiting reed, and a through hole of a positioning sheet to be locked into a locking hole of an adjusting rod. Thus, the adjusting rod, positioning sheet and limiting reed are locked as an integral body.

Referring to FIG. 6, a prior art lamp post is illustrated. A lamp assembling device includes a retainer 6 fixed to a distal end of a lamp rod, a positioning rod 7 locked to the retainer 6 and a lamp post 3 firmly secured to a top of the positioning rod 7. A lower end of the positioning rod 7 is vertically bent with a positioning sheet 71. A screw rod A locks into the lamp rod A from a screw hole 711 in a center of the positioning sheet 71. By locking the positioning rod 7 to a distal end of the lamp rod A, the assembly of the lamp rod A to the lamp post 3 is performed only at one predetermined orientation. Thus, the orientation is unchangeable as desired.

SUMMARY OF THE INVENTION

Accordingly, the primary object of the present invention is to provide a lamp assembling device with an orientation adjustable lamp post. In a retaining seat, a positioning sheet is locked to the distal end of the lamp rod. An upper section of a vertical surface of the positioning sheet has a locking hole. A lower end of the adjusting rod has a through hole. An embedding hole is formed on the adjusting rod at an upper side of the through hole. Thereby, a stud passes through the limiting reed and the locking hole of the positioning sheet to be locked into the through hole of the adjusting rod. Thus, the adjusting rod, positioning sheet and limiting reed are locked as an integral body. After locking, one free end of the limiting reed exactly extends into an embedding hole of the adjusting rod. As a result, the lamp post is adjustable.

The various objects and advantages of the present invention will be more readily understood from the following detailed description when read in conjunction with the appended drawing.

BRIEF DESCRIPTION OF THE DRAWINGS

FIG. 2A shows one embodiment of the present invention about the orientation adjustment of the present invention.

BRIEF DESCRIPTION OF THE PREFERRED EMBODIMENTS

Figure 1:
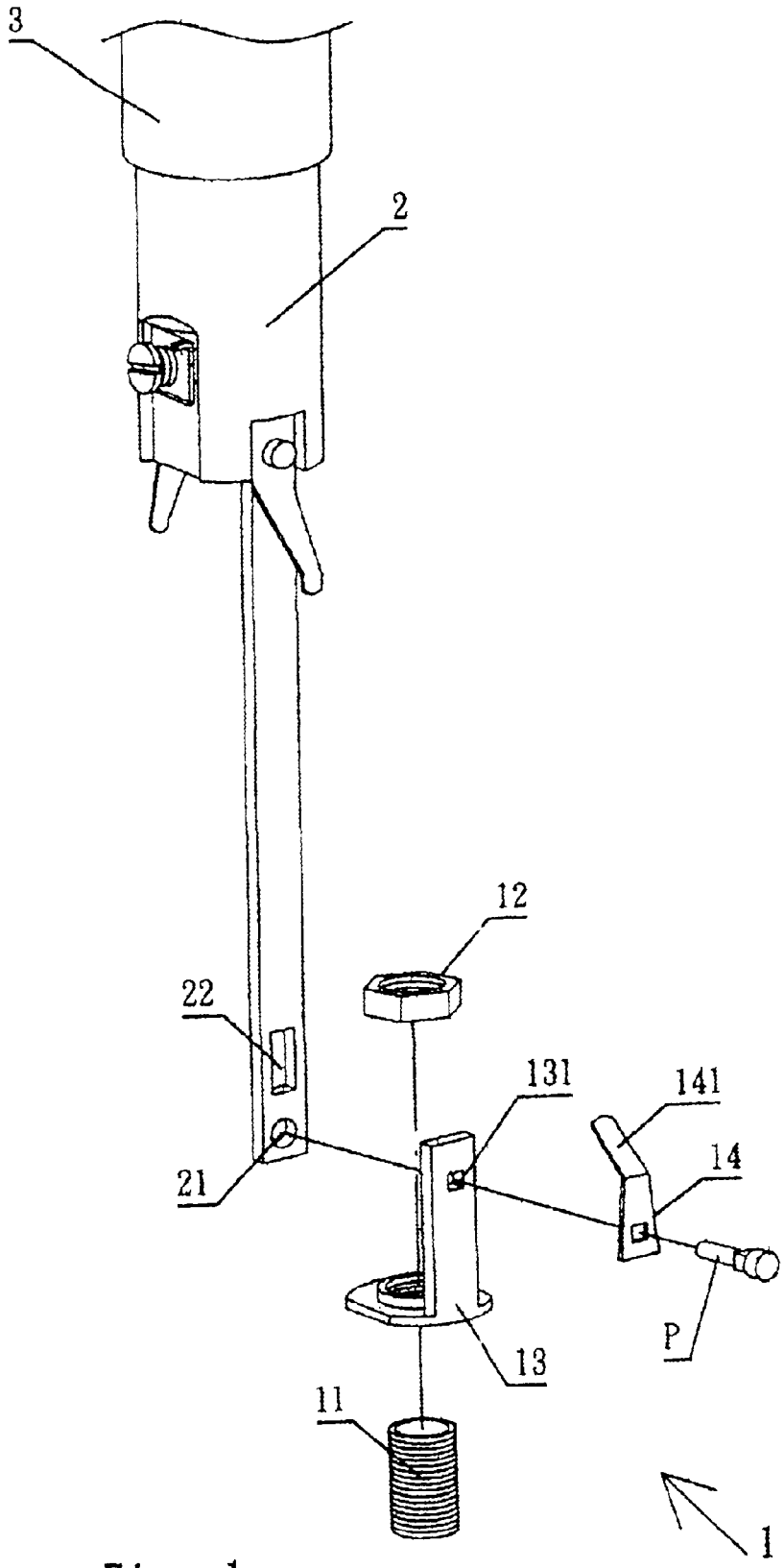
FIG. 1 is an exploded perspective view of the present invention.
Figure 2:
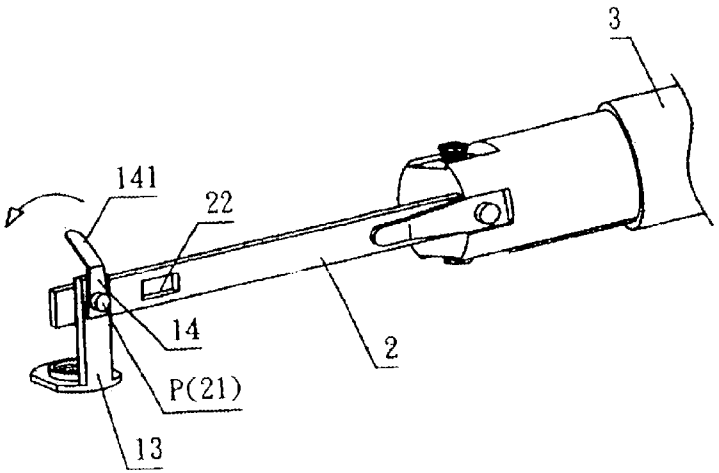
FIG. 2 is an assembled perspective view of the present invention.
Figure 2:
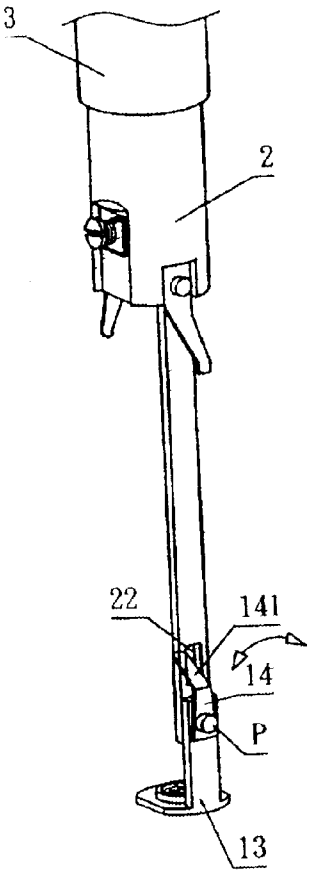

Referring to FIGS. 1 and 2, the structure of the present invention may be understood clearly. The present invention is formed by a retaining seat 1 firmly secured to a distal end of a lamp rod A, an adjusting rod 7 locking to the retaining seat 1, and a lamp post 3 firmly secured to a top of the adjusting rod 2.

In the retaining seat 1, a positioning sheet 13 is locked to the distal end of the lamp rod A by using a screw rod 11 and a nut 17. An upper section of a vertical surface of the positioning sheet 13 has a locking hole 131. A limiting reed 14 is locked to the through hole 131 by a stud P. A free end 141 of the limiting reed 14 is inclined inwards so as to be embedded into the embedding hole 22 at a lower end of the adjusting rod 2.

The lower end of the adjusting rod 2 has a through hole 21 at a position coupled to the locking hole 131 of the positioning sheet 13. An embedding hole 22 is formed on the adjusting rod 2 at the upper side of the through hole 21. Thereby, the stud P passes through the limiting reed 14 and the locking hole 131 of the positioning sheet 13 to be locked into the locking through 21 of the adjusting rod 2. Thus, the adjusting rod 2, positioning sheet 13 and limiting reed 14 are locked as an integral body. After locking, the inward inclined free end 141 of the limiting reed 14 exactly extends into the embedding hole 22 of the adjusting rod 2.

When the locking orientation of the adjusting rod 2 is adjusted, it is only necessary to release the stud P so that the adjusting rod 2 and the positioning sheet 13 are released. Then the adjusting rod 2 is screwed downwards to a predetermined orientation. The stud P is screwed again so that the adjusting rod 2 can drive the lamp post 3 to be fixed to a desired orientation (referring to FIG. 2A).

Thereby, the lamp can be assembled convenient and the orientation thereof can be adjusted easily.

Figure 3:
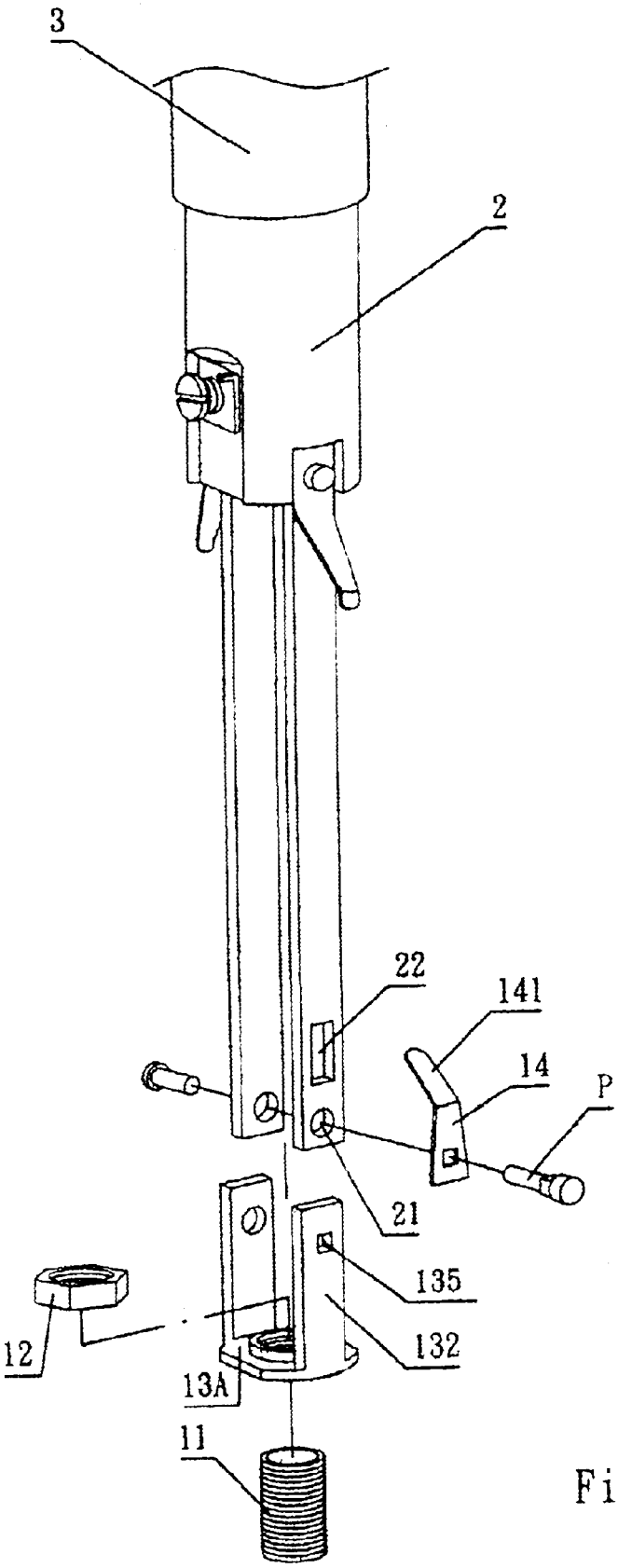
FIG. 3 shows another embodiment of the present invention where another form of positioning sheet is shown.
Figure 4:
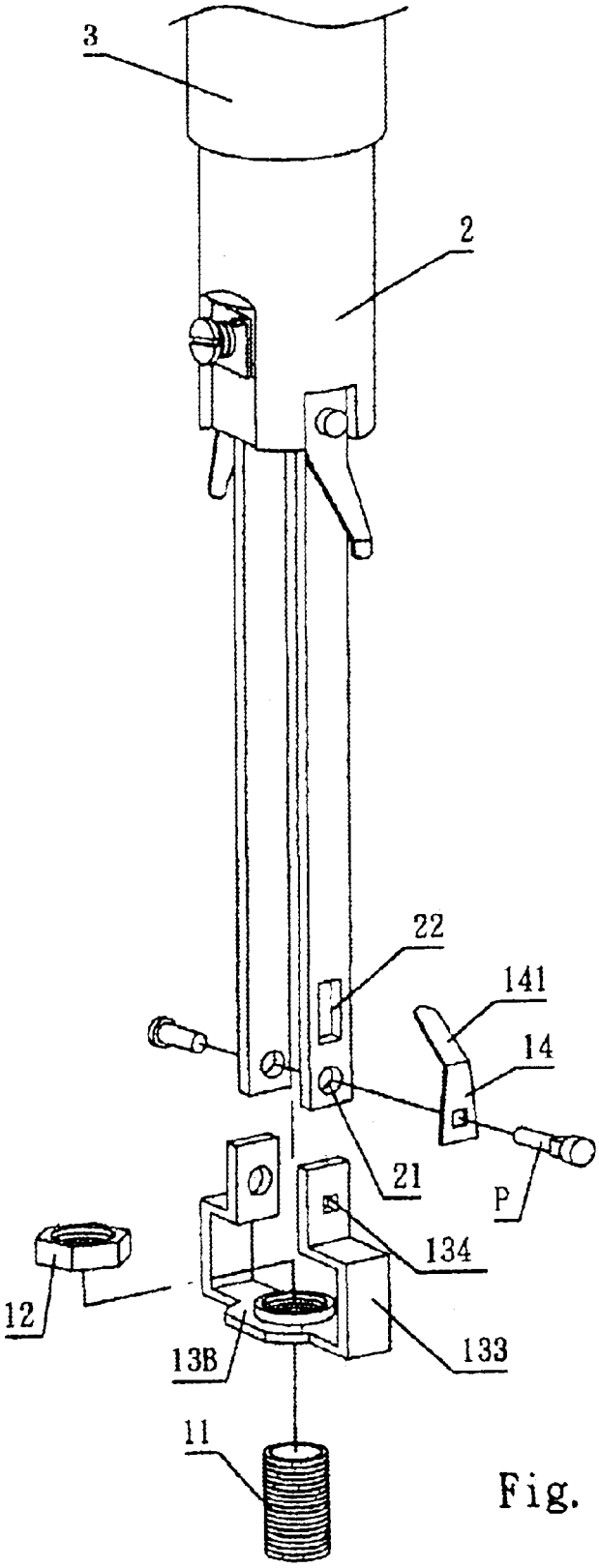
FIG. 4 shows a further embodiment of the present invention where another form of positioning sheet is shown.
Figure 5:
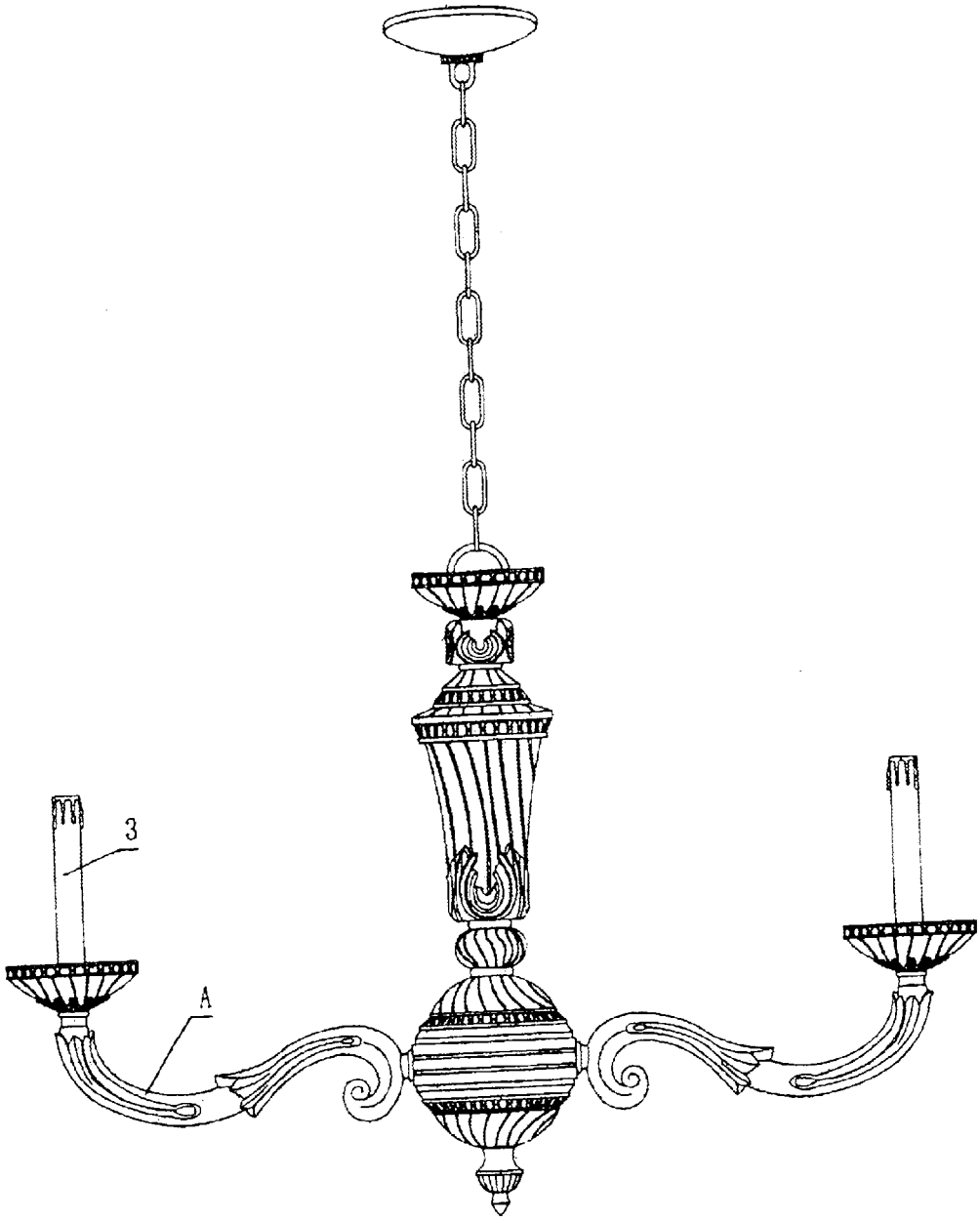
Fig. 5 (PRIOR ART)
FIG. 5 is one embodiment of the present invention showing a whole lamp according to the present invention.
Figure 6:
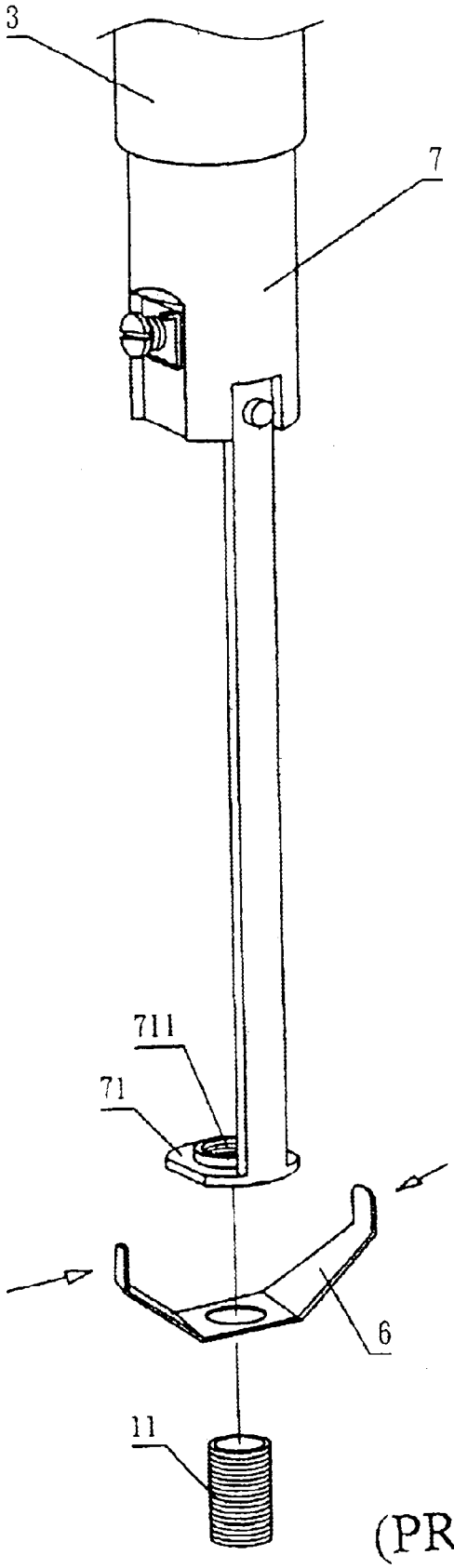
Fig. 6 (PRIOR ART)
FIG. 6 shows the prior art lamp rod and lamp post.

Referring to FIGS. 3 and 4, another embodiment of the present invention is illustrated. The retaining seat 1 contains a positioning sheet 13A (13B). Each of two sides of the positioning sheet 13A (13B) is extended with a locking sheet 132 (133). Each locking sheet has a locking hole 134 (135). A lower end of the adjusting rod 2 has a through hole 21 at a position coupled to the locking hole 134 (135) of the locking sheet 132 (133). A stud P passes through a limiting reed 14; the locking hole 134 (135) in the respective locking sheet 132 (133); and the through hole 21 in the adjusting rod 2 so as to lock the limiting reed 14; the locking sheet 132 (133) and the adjusting rod 2 together. Thereby, an inclined free end of the limiting reed is inserted into an embedding hole of the adjusting rod. Thus, the lamp post is adjustable by above components.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A lamp assembling device with an orientation adjustable lamp post; the lamp assembling device comprising a retaining seat firmly secured to a distal end of a lamp rod, an adjusting rod locking to the retaining seat, and a lamp post firmly secured to a top of the adjusting rod; wherein in the retaining seat, a positioning sheet is locked to a distal end of the lamp rod by using a screw rod and a nut; an upper section of a vertical surface of the positioning sheet has a locking hole; a limiting reed is locked to the locking hole by a stud; a free end of the limiting reed is inclined inwards; and a lower end of the adjusting rod has a through hole at a position coupled to the locking bole of the positioning sheet; an embedding hole is formed on the adjusting rod at an upper side of the through hole; thereby, the stud passes through the limiting reed and the locking hole of the positioning sheet to be locked into the through hole of the adjusting rod; thus, the adjusting rod, positioning sheet and limiting reed are locked as an integral body; after locking, the inward inclined free end of the limiting reed exactly extends into an embedding hole of the adjusting rod;

thus, the lamp post is adjustable by above components.

2. A lamp assembling device with an orientation adjustable lamp post; the lamp assembling device comprising a retaining seat firmly secured to a distal end of a lamp rod, an adjusting rod locking to the retaining seat, and a lamp post firmly secured to a top of the adjusting rod; wherein the retaining seat contains a positioning sheet; each of two sides of the positioning sheet is extended with a locking sheet; each locking sheet has a locking hole;

a lower end of the adjusting rod has a through hole at a position coupled to the locking hole of the locking sheet;

a stud passes through a limiting reed, the locking hole in the respective locking sheet; and the through hole in a respective one of the adjusting rod so as to lock the limiting reed, the locking sheet and the adjusting rod together; thereby, an inclined free end of the limiting reed is inserted into an embedding hole of the adjusting rod;

thus, the lamp post is adjustable by above components.

* * * * *